US005135802A

United States Patent [19]

Gstrein et al.

[11] Patent Number: 5,135,802

[45] Date of Patent: Aug. 4, 1992

[54] ABSORBER FELT

[75] Inventors: Hippolit Gstrein, Gloggnitz; Johann-Dieter Jochinger, Wiener Neustadt, both of Austria

[73] Assignee: Huyck Corporation, Wake Forest, N.C.

[21] Appl. No.: 802,883

[22] Filed: Dec. 6, 1991

[51] Int. Cl.[5] ..... B32B 5/02

[52] U.S. Cl. ..... 428/234; 139/383 A; 139/420 R; 428/257; 428/280; 428/300

[58] Field of Search ..... 428/234, 257, 300, 280; 139/420 R, 383 A

[56] References Cited

U.S. PATENT DOCUMENTS

| | | | |
|---|---|---|---|
| 4,187,618 | 2/1980 | Diehl | 139/383 A |
| 4,461,803 | 7/1984 | Booth et al. | 428/234 |
| 4,759,975 | 7/1988 | Sutherland et al. | 428/234 |

*Primary Examiner*—James J. Bell

*Attorney, Agent, or Firm*—Lorusso & Loud

[57] ABSTRACT

A papermaker's felt having a dual layer base with a high absorption capacity with a weave pattern having twice as many machine direction yarns on the top side of the fabric as compared to the bottom side of the fabric. The yarns may be spun yarns, multi-filaments, monofilaments, core-wrapped yarns and any kind of twists. Treated and extruded yarns may also be used. The base fabric is attached to a top fabric by needling.

2 Claims, 3 Drawing Sheets

ABSORBER FELT

BACKGROUND OF THE INVENTION

The invention relates to felts for use in papermaking machines, and has to do more particularly with felts for removing water from a paper sheet while the sheet is supported on and carried by the felt.

Various techniques have hitherto been proposed for removing water from a paper sheet, the most common being by the use of a press, wherein the paper sheet and the felt on which it is carried are squeezed between rollers, the felt being formed in such a manner that the water extracted from the paper will pass through the felt for discharge. Desirably, the press felts are woven so as to have relatively large open areas or voids which will enhance their water conveying capabilities so that the water may be removed from the felt upon passage over a suction box. The press felt normally has a conveyer belt-like shape and during the various operations previously mentioned, a large amount of water is built up in the press felt which is removed by suction or various other drainage devices, usually after the paper web and press felt are no longer in direct contact.

The ideal papermaking felt should have at least the following properties. First, it should have a surface that is fine enough to produce a smooth finish and minimize marking of the sheet of paper being produced. Second, it should be open enough to allow water to drain through it without significant impedance. Third, it should be resilient enough to quickly recover from repeated high nip pressures over a long period of time. Fourth, it should be tough and strong enough to provide good stability, wear resistance and felt life.

It has been found that a papermaker's felt having a base fabric with a high vibration absorption capacity compared to the usual dual layer fabrics provides better runnability, fewer maintenance stops and improved paper quality.

Accordingly, is an object of the present invention to provide a fabric for use in papermaking machine having improved vibration absorption capacity.

It is a further object to provide a felt having high elasticity and resilience to assure better runnability, less maintenance stops and improved paper quality.

It is a further object of the invention to provide a papermaker's felt with improved dewatering performance.

It is another object of the present invention to provide a felt having longer lasting resiliency for better wet felt performance on heavily loaded, high-speed positions.

SUMMARY OF THE INVENTION

These and other objects, as will be apparent to those skilled in the art, may be achieved from practice of the present invention, one embodiment of which is a papermakers felt having a dual layer base fabric woven in a special weave pattern which results in a base fabric having energy absorbing characteristics. The yarns are woven in a pattern in which the number of machine direction yarns on the top side of the fabric is twice the number of the machine direction yarns on the bottom side of the fabric. The yarns may be spun yarns, multifilaments, monofilaments, core-wrapped yarns or any kind of twists. The bottom fabric is attached to a top fabric by needling. A preferred top fabric is a single layer fabric with long floatings and fine yarn components.

A felt having the absorber base fabric of the present invention having the special weave pattern shows significantly higher vibration absorption capacity compared to usual felts. High elasticity and resilience assure better runnability, fewer maintenance stops and improved paper quality. The concept reduces flow resistance giving better dewatering performance. By using the top fabric together with the absorber fabric, the requirements of the felt are adapted to paper quality (weight, surface) and press conditions (speed, pressure, runnability). In addition to being used as a component of a papermaker's felt, the base fabric may be used as a forming fabric in a papermaking machine.

In a second embodiment, the yarns of the base fabric are treated or extruded with elastic resins or polymeric materials having superior dampening characteristics. Materials include monofilaments or multi/monofilaments twists in machine direction, which can be treated or extruded with elastic resins (polyurethane, latex, polyacrylic, etc). An example of a suitable fiber is thermoplastic polyester elastomer, or TPE. The specially treated yarns are provided in the machine direction to provide a papermaking fabric having improved vibration dampening ability.

BRIEF DESCRIPTION OF THE DRAWINGS

An understanding of this invention may be had from the detailed discussion which follows and from an examination of the drawing in which.

DETAILED DESCRIPTION OF THE PREFERRED EMBODIMENT

Figure 3:
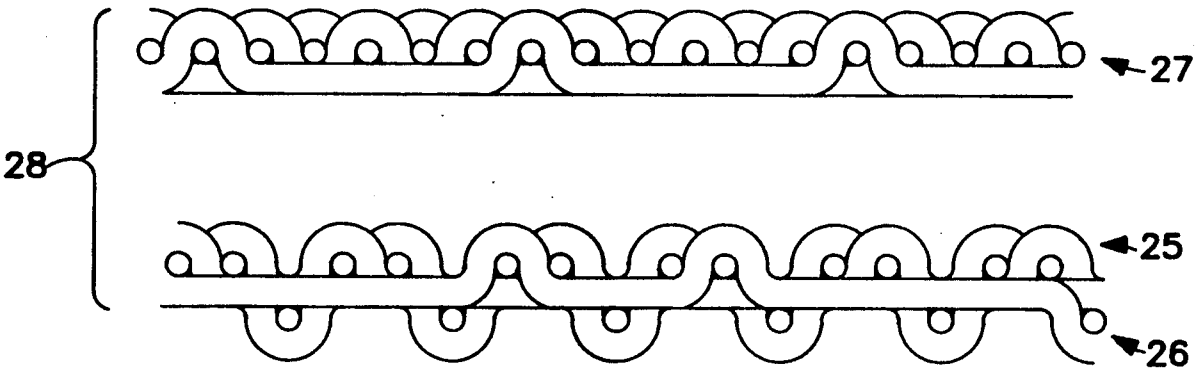
FIG. 3 is a schematic representation of the path of the cross-machine direction yarns in relation to the machine direction yarns showing the top fabric and the base fabric.

In a first embodiment, the felt is comprised of a dual layer base fabric 28 woven in a special pattern to improve its dampening characteristics, in combination with a top fabric 27, as shown in FIG. 3. The base fabric 28 can function either as a forming fabric for use in a papermaking machine, or when it is combined with a top fabric 27, as a papermaker's felt. The dual layer base fabric consists of a fabric having sets of either machine direction yarns or cross machine direction yarns in more than one plane. Dual layer fabrics are manufactured in two basic ways to form an endless belt. First, they can be woven by a flat weaving process with their ends joined by any one of a number of well known methods to form the endless belt. Alternatively, they can be woven directly in the form of a continuous belt by means of an endless weaving process. Both methods are well known in the art and the term "endless belt" as used herein refers to belts made by either method. In a flat woven papermakers fabric, the warp yarns extend in the machine direction and the filling yarns extend in the cross machine direction. In a papermakers fabric having been woven in an endless fashion the warp yarns extend in the cross machine direction and the filling yarns extend in the machine direction. As used herein the terms "machine direction" and "cross machine direction" refer respectively to a direction corresponding to the direction of travel of the papermakers fabric on the papermaking machine and a direction transverse this direction of travel.

Figure 1:
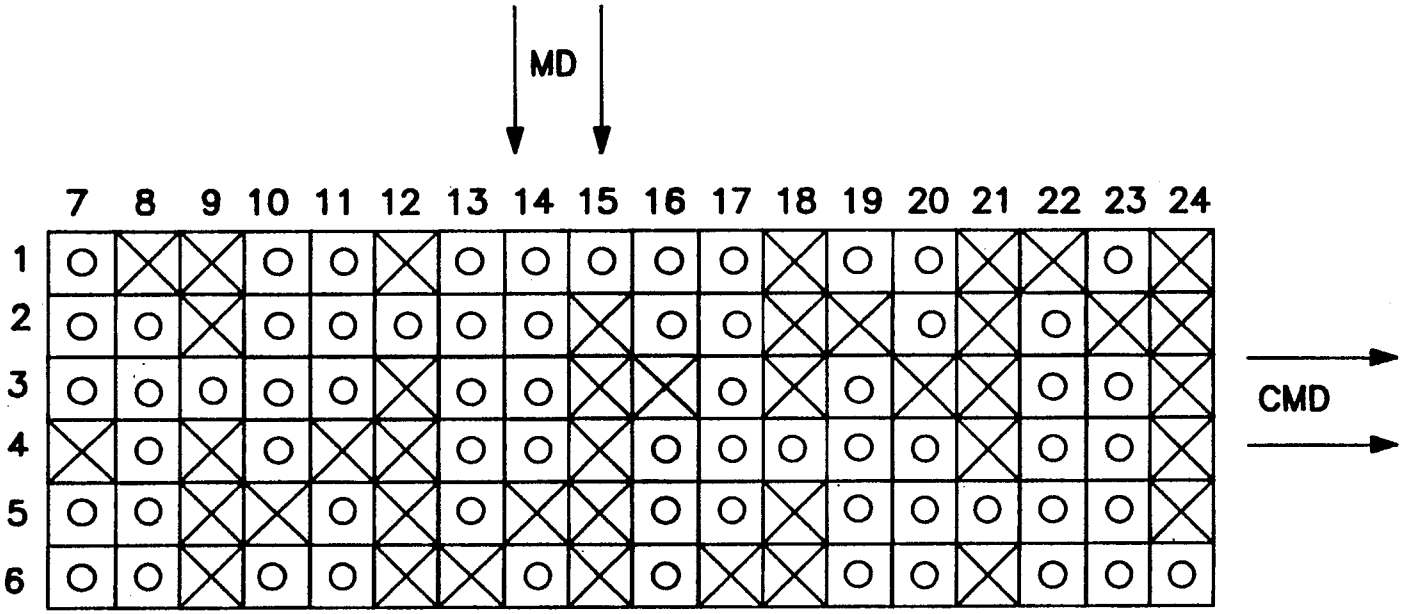
FIG. 1 is a weave diagram illustrating the weave pattern of the base fabric.

Reference is made to FIG. 1. This figure is a weave diagram illustrating the weave pattern of the fabric of the present invention on six harnesses. The six horizontal rows of the diagram, numbered 1 through 6, represent six cross-machine direction yarns. The vertical columns of the diagram numbered 7 through 24 represent 18 machine direction yarns. The "X" marks on the diagram represent those points at which the machine direction yarns are woven under the cross-machine direction yarn indicated at that point. The "0" marks in the diagram illustrate those points at which the machine direction yarns are woven above the cross-machine direction yarn indicated in that point.

The pattern repeats on every six cross-machine direction yarns and on every 18 machine direction yarns. In the various figures, one weave repeat is designated as 1 through 6 for the cross-machine direction yarns and 7 through 24 for the machine direction yarns.

Figure 2:
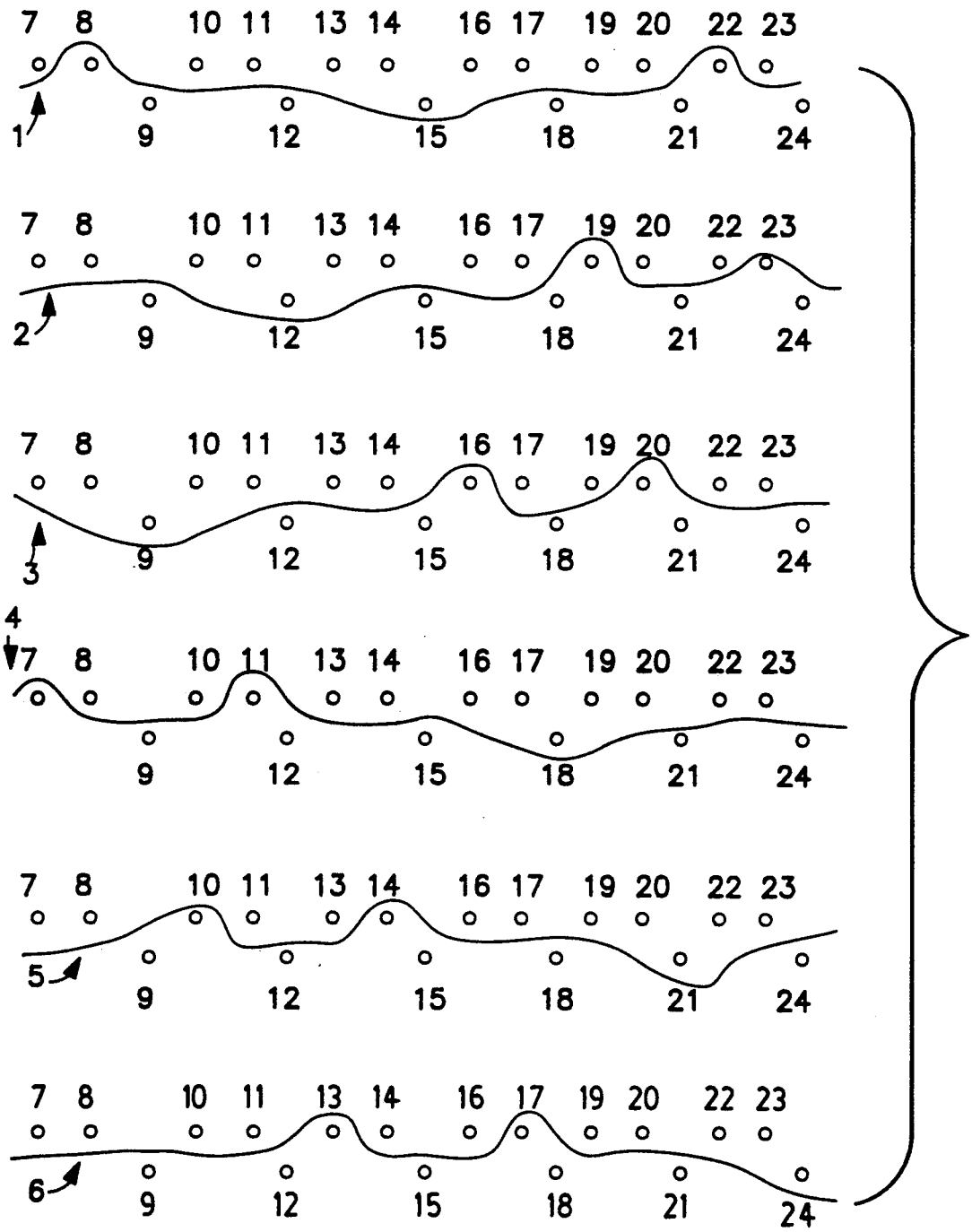
FIG. 2 is a schematic representation of the path of the cross-machine direction yarns in relation to the machine direction yarns.

FIG. 2 is a schematic cross-sectional representation of the path of the cross-machine direction yarns of the base fabric of the present invention. It illustrates the six cross-machine direction yarns in one weave repeat and shows their relative position with respect to the same machine direction yarns.

Numbers 7, 8, 10, 11, 13, 14, 16, 17, 19, 20, 22 and 23 refer to the machine direction yarns on the top side 25 of the fabric 28. Numbers 9, 12, 15, 18, 21 and 24 refer to the machine direction yarns on the bottom side 26 of the fabric 28. It is clear that the fabric 28 has twice as many machine direction yarns on the top side 25 as it has on the bottom side 26.

FIG. 3 shows a cross sectional view of the fabric 28 together with a top fabric 27. The top fabric 27 may be any fabric needled to the base fabric 28 in the conventional manner. A preferred top fabric is a single layer fabric with long floatings and fine yarn components (i.e., 0.2 mm×2 ply or 0.15 mm×3 ply, etc.). When the weave pattern of the present invention is used, an increase in hysteresis of greater than 25 percent (25%) has resulted. The vibration dampening characteristics are tested by measuring elasticity modulus and loading hysteresis on a load tester. The dampening characteristics depend on the flexibility of the base fabric 28 or the base fabric 28 in combination with the top fabric 27.

The second embodiment includes the use of yarns in the machine direction that are treated or extruded with elastic resins or polymers. Preferred materials include monofilaments or multi/monofilament twists in machine direction which can be treated or extruded with elastic resins such as polyurethane, latex, polyacrylic, etc. The use of such materials provides a further improvement in hysteresis values.

An example of a suitable fiber is "thermoplastic polyester elastomer" or TPE. For example, the yarn may be 0.020 inch diameter "Riteflex" made by Hoechest Celanese. Thermoplastic polyester elastomer should be available from the supplier in monofilament diameters between 0.004 inches and 0.060 inches. This material could be used in multifilament form as well. There are other polymers available that also have energy absorbing characteristics.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalence of the claims are therefore intended to be embraced therein.

What is claimed is:

1. A papermaker's felt comprising a six harness dual layer weave base fabric having a pattern of woven cross-machine direction yarns and machine direction yarns wherein in a first harness, a cross-machine direction yarn passes beneath a machine direction, above two machine direction yarns, beneath two machine direction yarns, above a machine direction yarn, beneath five machine direction yarns, above a machine direction yarn, beneath two machine direction yarns, above two machine direction yarns, beneath a machine direction yarns and above a machine direction yarns;

in a second harness, a cross-machine direction yarn passes beneath two machine direction yarns, above a machine direction yarn, beneath five machine direction yarns, above a machine direction yarn, beneath two machine direction yarns, above two machine direction yarns, beneath a machine direction yarn, above a machine direction yarn, beneath a machine direction yarn and above two machine direction yarns;

in a third harness, a cross-machine direction yarn passes beneath five machine direction yarns, above a machine direction yarn, beneath two machine direction yarns, above two machine direction yarns, beneath a machine direction yarn, above a machine direction yarn, beneath a machine direction yarn, above two machine direction yarns, beneath two machine direction yarns and above a machine direction yarn;

a fourth harness, a cross-machine direction yarn passes above a machine direction yarn, beneath a machine direction yarn, above a machine direction yarn, beneath a machine direction yarn, above two machine direction yarns, beneath two machine direction yarns, above a machine direction yarn, beneath five machine direction yarns, above a machine direction yarn, beneath two machine direction yarns, and above a machine direction yarn;

in a fifth harness, a cross-machine direction yarn passes beneath two machine direction yarns, above two machine direction yarns, beneath a machine direction yarn, above a machine direction yarn, beneath a machine direction yarn, above two machine direction yarns, beneath two machine direction yarns, above a machine direction yarn, beneath five machine direction yarns and above a machine direction yarn, and in a sixth harness, a cross-machine direction yarn passes beneath two machine direction yarns, above a machine direction yarn, beneath two machine direction yarns, above two machine direction yarns, beneath a machine direction yarn, above a machine direction yarn, beneath a machine direction yarn, above two machine direction yarns, beneath two machine direction yarns, above a machine direction yarn and beneath three machine direction yarns, said pattern repeating on every 6 cross-machine direction yarn and on every 18 machine direction yarns, and said base fabric having an upper surface and a bottom surface wherein the number of machine direction yarns on the upper surface is twice the number of machine direction yarns on the bottom surface;

and an upper fabric needled to said base fabric.

2. A six harness dual layer weave fabric for use in a papermaking machine comprising a pattern of woven cross-machine direction yarns and machine direction yarns wherein in a first harness, a cross-machine direction yarn passes beneath a machine direction, above two machine direction yarns, beneath two machine direction yarns, above a machine direction yarn, beneath five machine direction yarns, above a machine direction yarn, beneath two machine direction yarns, above two machine direction yarns, beneath a machine direction yarns and above a machine direction yarns;

in a second harness, a cross-machine direction yarn passes beneath two machine direction yarns, above a machine direction yarn, beneath five machine direction yarns, above a machine direction yarn, beneath two machine direction yarns, above two machine direction yarns, beneath a machine direction yarn, above a machine direction yarn, beneath a machine direction yarn and above two machine direction yarns;

in a third harness, a cross-machine direction yarn passes beneath five machine direction yarns, above a machine direction yarn, beneath two machine direction yarns, above two machine direction yarns, beneath a machine direction yarn, above a machine direction yarn, beneath a machine direction yarn, above two machine direction yarns, beneath two machine direction yarns and above a machine direction yarn;

in a fourth harness, a cross-machine direction yarn passes above a machine direction yarn, beneath a machine direction yarn, above a machine direction yarn, beneath a machine direction yarn, above two machine direction yarns, beneath two machine direction yarns, above a machine direction yarn, beneath five machine direction yarns, above a machine direction yarn, beneath two machine direction yarns, and above a machine direction yarn;

in a fifth harness, a cross-machine direction yarn passes beneath two machine direction yarns, above two machine direction yarns, beneath a machine direction yarn, above a machine direction yarn, beneath a machine direction yarn, above two machine direction yarns, beneath two machine direction yarns, above a machine direction yarn, beneath five machine direction yarns and above a machine direction yarn, and in a sixth harness, a cross-machine direction yarn passes beneath two machine direction yarns, above a machine direction yarn, beneath two machine direction yarns, above two machine direction yarns, beneath a machine direction yarn, above a machine direction yarn, beneath a machine direction yarn, above two machine direction yarns, beneath two machine direction yarns, above a machine direction yarn and beneath three machine direction yarns, said pattern repeating on every 6 cross-machine direction yarn and on every 18 machine direction yarns, and said fabric having an upper surface and a bottom surface wherein the number of machine direction yarns on the upper surface is twice the number of machine direction yarns on the bottom surface.

* * * * *